US006570542B2

(12) United States Patent
Jan et al.

(10) Patent No.: US 6,570,542 B2
(45) Date of Patent: May 27, 2003

(54) INTEGRATED DUAL-DIRECTIONAL FEED HORN

(75) Inventors: Cheng-Geng Jan, Taipei Hsien (TW); Tzung-Fang Huang, Taipei Hsien (TW); Lai Chungmin, Taipei Hsien (TW)

(73) Assignee: Acer NeWeb Corp., Taipei Hsien (TW)

( * ) Notice: Subject to any disclaimer, the term of this patent is extended or adjusted under 35 U.S.C. 154(b) by 0 days.

(21) Appl. No.: 09/906,804

(22) Filed: Jul. 18, 2001

(65) Prior Publication Data

US 2002/0008671 A1 Jan. 24, 2002

(30) Foreign Application Priority Data

Jul. 20, 2000 (TW) ..... 89114552 A

(51) Int. Cl.[7] ..... H01Q 13/00
(52) U.S. Cl. ..... 343/778; 343/772; 343/776
(58) Field of Search ..... 343/772, 776, 343/778, 840, 761

(56) References Cited

U.S. PATENT DOCUMENTS 5,600,336 A * 2/1997 Kubo et al. ..... 333/248
5,812,096 A * 9/1998 Tilford ..... 343/776
5,818,396 A * 10/1998 Anderson et al. ..... 333/126
6,121,939 A * 9/2000 Imaizumi et al. ..... 343/756
6,166,704 A * 12/2000 Jan et al. ..... 343/786
6,222,495 B1 * 4/2001 Cook et al. ..... 343/832
6,313,808 B1 * 11/2001 Yuanzhu ..... 343/786
6,320,554 B1 * 11/2001 Yuanzhu ..... 343/772
2001/0054984 A1 * 12/2001 Spirtus ..... 343/840

* cited by examiner

*Primary Examiner*—Don Wong
*Assistant Examiner*—Shih-Chao Chen
(74) *Attorney, Agent, or Firm*—Bacon & Thomas, PLLC

(57) ABSTRACT

An integrated dual-directional feed horn, for receiving RF signals from two satellites in small angle, includes a LNBF (first low noise block with integrated feed) and a second LNBF. The antenna dish focus the received RF signals onto receipt points of the focus plane, and the two LNBFs receive focused RF signals. The first LNBF receives circular polarized waves from the BSS satellite. The second LNBF receives linear polarized waves from the FSS satellite. One characteristic of the invention relies on integrating two LNBFs and making the two LNBFs adjacent to each other in the direction of short axis. Accordingly, the two LNBFs receive RF signals from two satellites in small angle. Increasing the length of the long axis thereof increases the areas of the wave-guides. The signal gain and communication quality are obtained.

7 Claims, 4 Drawing Sheets

INTEGRATED DUAL-DIRECTIONAL FEED HORN

REFERENCE TO RELATED APPLICATION

The present application claims priority of Taiwan application Ser. No. 89114552, filed on Jul. 20, 2000, and the contents thereof are herein incorporated as reference.

BACKGROUND OF THE INVENTION

1. Field of the Invention

The invention relates to an integrated dual-directional feed device, and more particularly relates to an integrated dual-directional feed device for receiving signals from two satellites in small angle.

2. Description of the Related Art

Due to rapid improvement of the high technology, it becomes more popular in signal transmission via satellites. In signal transmission via satellite, the coverage area of signal is wide; and the signal transmission path is not easily negatively affected by landforms. Therefore, there are more technique developments on signal transmission via satellite.

Now referring to FIG. 1, which shows signal transmission between a satellite and an antenna disk. The satellite 10 rotates around Earth in a synchronized orbit. When an RF (radio frequency) signal is transmitted from an earth station 12 to an antenna dish 14 for destination, the RF signal is transmitted to the satellite 10 first. Then, the RF signal is transmitted from the satellite 10 to the antenna dish 14. That is, in signal transmission, the satellite 10 is considered as a relay satellite.

There are a variety of usages on the satellite. The usages includes military affairs, direct TV programs, weather, Internet and so on. In home applications, the direct program system and Internet applications are most popular. For direct program system, the signal transmission between the satellite and the antenna dish is in single direction. In single-direction transmission, RF signals are mainly formed as circular polarized waves. However, in Internet applications, dual-directional transmission is applied, and RF signals should be formed as linear polarized waves so as to provide the bandwidth.

In direct program applications, a BSS satellite at West longitude 119° transmits RF signals in circular polarized waves toward destination stations. In Internet applications, An FSS satellite at West longitude 116.8° transmits and receives RF signals between destination stations. The BSS satellite is separated from the FSS satellite in a very small angle (2.2°) Therefore, in the same antenna dish for receiving signals from the BSS satellite and the FSS satellite, there must be a solution to separate the received signals.

The signals may be transmitted from the two satellites through two separate antenna dishes. However, it is high cost when using two antenna dishes. Some present antenna dishes are designed for receiving and transmitting signals between two or more satellites.

Now referring to FIG. 2A, it shows a conventional antenna dish. The reflection surface 22 of the antenna dish 20 is parabolic for focusing received signals onto the focus plane, and the signal gain on each point on the focus plane is above a predetermined level. A number of feed horns 25 maybe installed on the focus plane for receiving signals from a number of satellites.

For the conventional antenna dishes 20 for receiving signals from two satellites, there are two feed horns on the focus plane. If the two satellites, for example the BSS satellite and the FSS satellite in a 2.2° angle, separate from each other within a small angle, the two receipt points on the focus plane may be close to each other. If so, the two feed horns 25*a* and 25*b* should be close to each other for receiving signals well.

In tradition, the first feed horn 25*a* and the second feed horn 25*b* are both located on the focus plane of the antenna dish 20. The first feed horn 25*a* receives circular polarized waves from the BSS satellite. The receiving band is about 12.2 GHz 12.7 GHz. The second feed horn 25*b* receives and transmits linear polarized waves between the FSS satellite. The receiving band is about 11.7 GHz~12.2 GHz, and the transmitting band is about 14 GHz~14.5 GHz.

Now please refer to FIG. 2B. Because the angle between the BSS satellite and the FSS satellite is so small, the respective receipt points for receiving signals from the two satellites are also close to each other. Due to this limitation, if the antenna dish is applied with a traditional circular LNBF (low noise block with integrated feed), the radius of the circular LNBF is limited. Accordingly, the communication quality is also negatively affected.

The circular wave-guide tube of the conventional LBNF should be large enough for obtaining enough gain in receiving signals from two satellites in a small angle. A large wave-guide tube makes the feed horn difficult to focus RF waves from satellites and the enlarged antenna dish is high cost. On the other hand, a small wave-guide tube reduces signal gain. It is an important issue to trade off between gain and area of the wave-guide.

SUMMARY OF THE INVENTION

One of the objects of the invention is to provide an integrated dual-directional feed horn for receiving RF signals from two satellites in small angle.

In the invention, the integrated dual-directional feed horn, for receiving RF signals from two satellites in small angle, includes a first LNBF (low noise block with integrated feed) and a second LNBF. The antenna dish focus the received RF signals onto receipt points of the focus plane, and both the LNBFs receive focused RF signals. Wherein, the first LNBF receives circular polarized waves from the BSS satellite and the second LNBF receives linear polarized waves from the FSS satellite. In the invention, for receiving RF signals from two satellites in a small angle, the distance between the two LNBFs is short and the area of the wave-guides tube should be large enough for better signal gain.

Therefore, one characteristic of the invention relies on integrating two LNBFs and making the two LNBFs adjacent to each other in the direction of short axis. Accordingly, the two LNBFs receive RF signals from two satellites in small angle. Increasing the length of the long axis thereof increases the areas of the wave-guide tubes. The signal gain and communication quality are obtained.

BRIEF DESCRIPTION OF DRAWINGS

The following detailed description, given by way of examples and not intended to limit the invention to the embodiments described herein, will best be understood in conjunction with the accompanying drawings, in which.

DETAILED DESCRIPTION OF THE INVENTION

Figure 1:
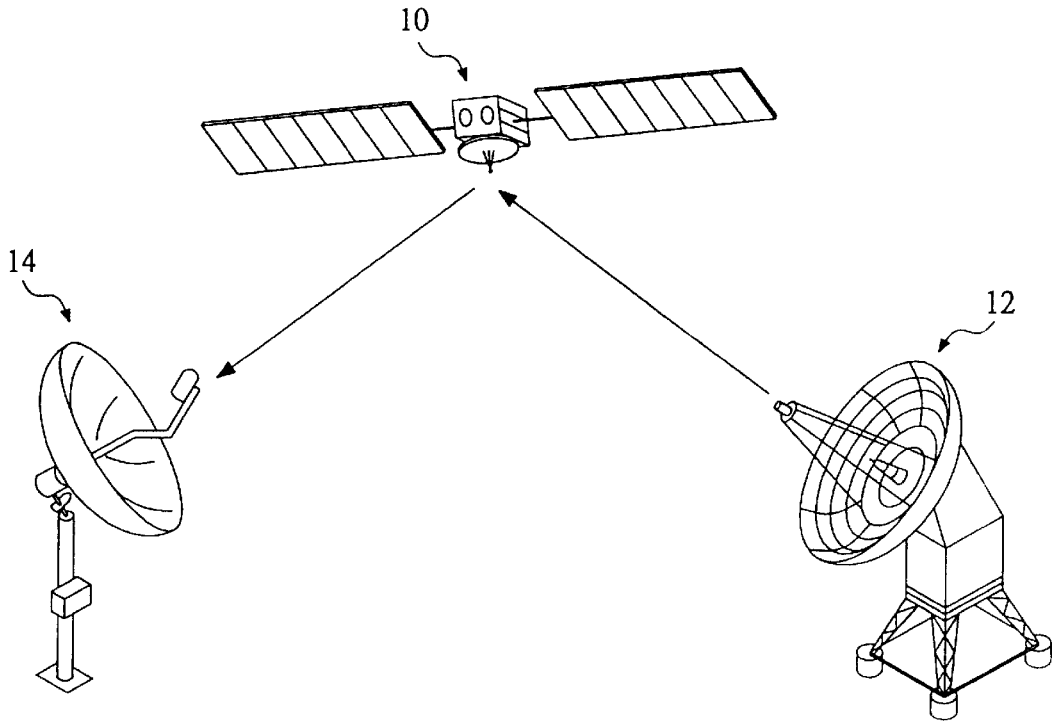
FIG. 1 Prior Art
FIG. 1 shows signal transmission between an earth station, a satellite and a destination antenna.
Figure 2A:
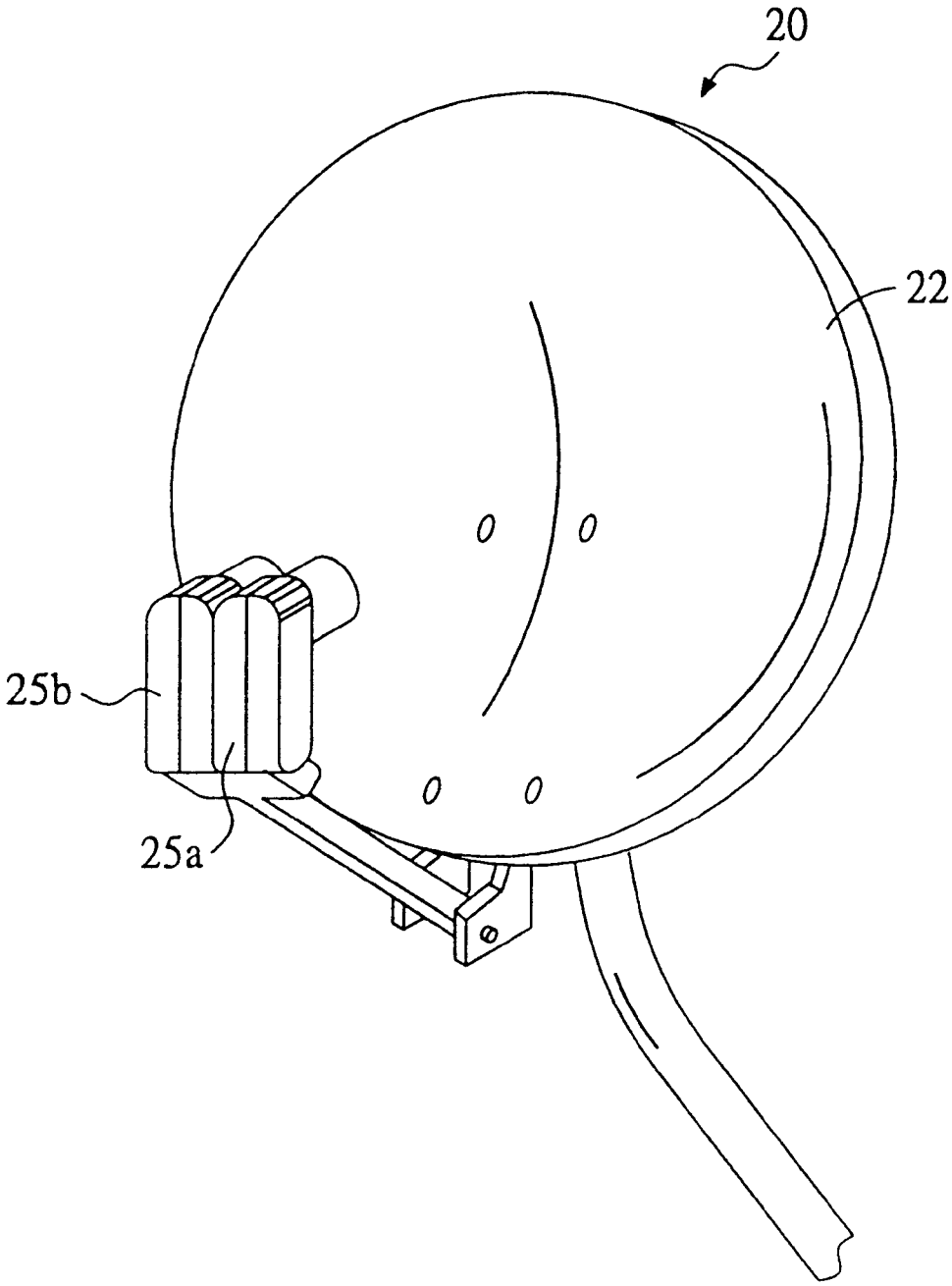
FIG . 2A Prior Art
FIGS. 2A and 2B respectively show traditional antenna dish.
Figure 2B:
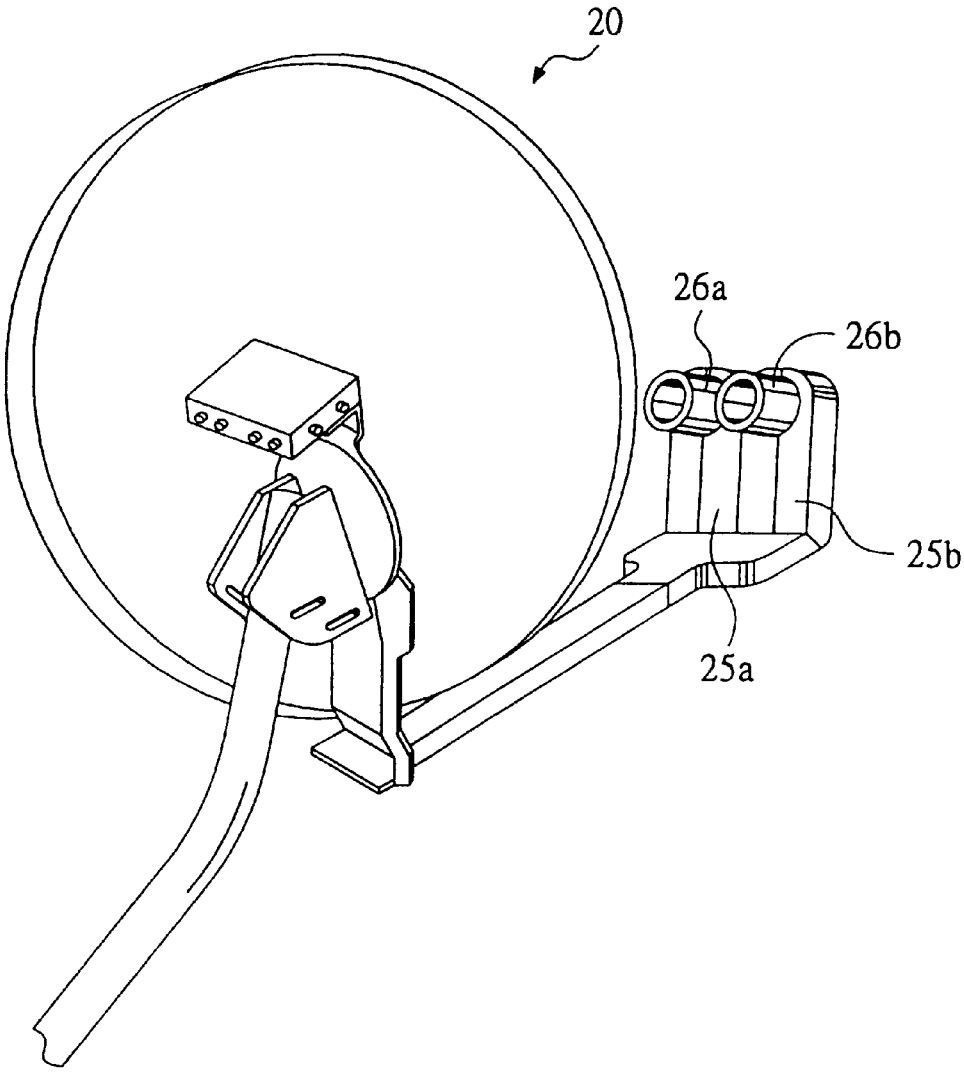
FIG . 2B Prior Art
Figure 3:
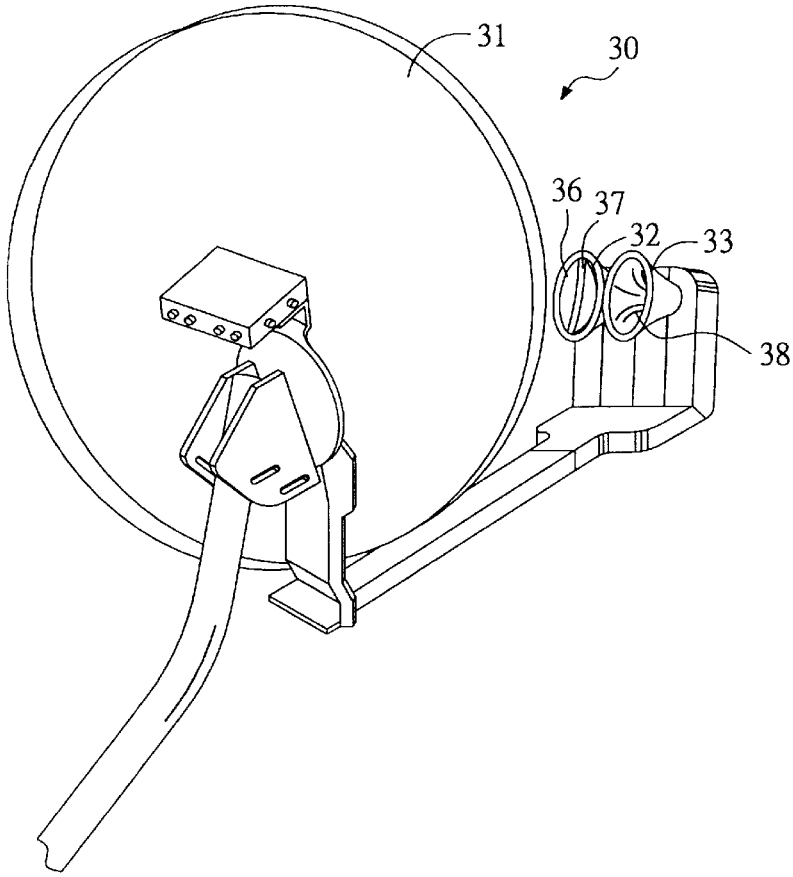
FIG. 3 shows one embodiment of the integrated dual-directional feed horn of the invention.

Please refer to FIG. 3, which shows one embodiment of the integrated dual-directional feed horn of the invention. The integrated dual-directional feed horn receives RF signals from two satellites within a small angle, for example BSS satellite in West longitude 119° and FSS satellite in West longitude 116.8°.

The integrated dual-directional feed horn 30 comprises a first low noise block with integrated feed (LNBF) 32 and a second LNBF 33. The antenna dish 31 has a special reflection plane for focusing the received RF signals onto a focus plane of the antenna dish 31. The signal gain reaches a predetermined level. The first and second LNBFs 32 and 34 are installed on the focus plane of the antenna dish for obtaining a better signal gain.

The first LNBF 32 is installed on the focus plane of the antenna dish 31 wherein a wave-guide tube 36 is used for receiving RF signals. The wave-guide tube 36 is horn-like so as to reduce the reflection energy of the RF signals. The diameter of the wave-guide tube 36 is decreasing from outer to inner thereof.

The first LNBF 32 receives circular polarized wave from the BSS satellite. When left-rotating circular polarized waves or right-rotating circular polarized waves enter the wave-guide tube 36, the phase of the vertical and horizontal electrical field thereof changes because of the difference between the propagation coefficients of the electrical fields. Accordingly, the pure left-rotating circular polarized waves or right-rotating circular polarized waves become hybrid waves including both left-rotating circular polarized waves and right-rotating circular polarized waves. The hybrid waves result from reduction in isolation between different polarized waves. For compensating this reduction, a phase compensator 37 is added into the major axis of the wave-guide tube 36. The phase compensator 37 compensates phase difference between circular polarized waves in the wave-guide tube 36. The phase compensator 37 is an inner curved metal-plate and is integrated into the rear end of the wave-guide tube 36.

The second LNBF 33 has a similar structure with the first LNBF 32. The second LNBF 33 also has an elliptical wave-guide 38 for reducing reflection signals. The second LNBF 33 receives and transmits linear polarized waves between the FSS satellite.

For facilitating signal receipt and transmitting between the antenna dish 31 and the two satellites (BSS satellite and FSS satellite), in the present invention, the first LNBF 32 and the second LNBF 33 are integrated. The two wave-guides tube 36 and 38 of the two LNBFs are adjacent in the direction of short axis of the ellipse for making the two LNBFs more close to each other. Besides, for improving signal gains and quality, the length of long axis of the ellipse is adjustable.

Figure 4:
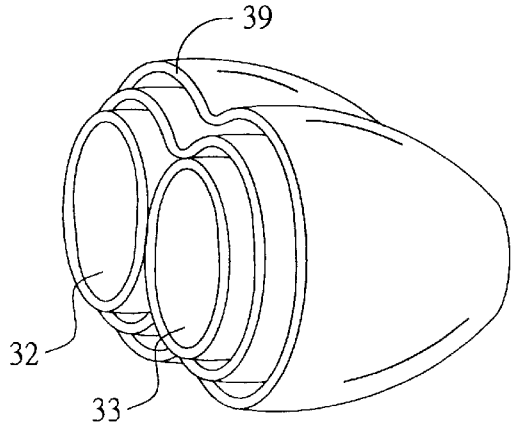
FIG. 4 shows another embodiment of the integrated dual-directional feed horn of the invention.

Now referring to FIG. 4, which shows another embodiment of the integrated dual-directional feed horn of the invention. In this example, the LNBFs 42 and 43 respectively have backward corrugations 39 for reducing backward noise.

Therefore, the integrated dual-directional feed horn has following advantages.

(1) The first and second LNBFs are adjacent to each other in the direction of short axis, so the two LNBFs receive and transmit signals between two satellites in small degree.

(2) The length of the long axis in the two LNBFs is maintained for obtaining enough signal gain and communication quality.

While the invention has been described in detail with reference to certain preferred embodiments, it should be appreciated that the invention is not limited to those precise embodiments. Rather, in view of the present disclosure that describes the current best mode for practicing the invention, many modifications and variations would present themselves to those of skill in the art without departing from the scope and spirit of the invention. The scope of the invention is, therefore, indicated by the following claims rather than by the foregoing description. All changes, modifications and variations coming within the meaning and range of equivalency of the claims are to be considered with in their scope.

What is claimed is:

1. An integrated dual-directional feeding device, combined with an antenna dish for receiving RF signals from two satellites within a predetermined angle, said integrated dual-directional feeding device comprising:

a first low noise block with an integrated feed (LNBF), installed on a focus plane of the antenna dish, and having a first elliptic wave-guide tube for receiving RF signals from one of said satellites;

a second LNBF, installed on the focus plane of the antenna dish, having a second elliptic wave-guide tube for receiving RF signals from and transmitting RE signals to the other satellite;

wherein the first and second wave-guide tubes are adjacent to each other in a short-axial direction of said elliptic wave-guide tubes, the lengths of the long-axes thereof are adjustable for improving gains of the first and second LNBFs; the first LNBF receives circular polarized waves, and the first wave-guide tube comprises a phase compensator for compensating phases of circular polarized waves in the first LNBF.

2. The integrated dual-directional feeding device of claim 1 wherein the first and second wave-guide tubes are formed as horn-like for reducing signal reflection.

3. The integrated dual-directional feeding device of claim 1, wherein the phase compensator is an arc structure metal.

4. The integrated dual-directional feeding device of claim 1, wherein the second LBNF receives and transmits a linear polarized wave between a FSS satellite.

5. The integrated dual-directional feeding device of claim 1, wherein the first and second LBNFs are integrated.

6. The integrated dual-directional feeding device of claim 1, further comprising a tapered corrugation.

7. A feeding device, combined with an antenna dish for communicating signals with two satellites, said feeding device comprising:

a first low noise block with an integrated feed (LNBF), installed on a focus plane of the antenna dish, and having a first wave-guide tube for communicating with one of said satellites; and a second LNBF, installed on the focus plane of the antenna dish, and having a second wave-guide tube for communicating with the other satellite, the first and second wave-guide tubes being adjacent to each other;

wherein the first wave-guide tube comprises a phase compensator for compensating phases of circular polarized waves in the first LNBF.

* * * * *